United States Patent [19]

Schmitz

[11] Patent Number: 4,712,470

[45] Date of Patent: Dec. 15, 1987

[54] METHOD AND APPARATUS FOR COMPENSATING THE VARIABLE WEIGHT OF A MASS ACTING ON A HYDRAULIC DRIVE, IN PARTICULAR FOR THE UPRIGHT DRIVE CYLINDER OF A LAPPING MACHINE

[75] Inventor: Jürgen Schmitz, Marktheidenfeld, Fed. Rep. of Germany

[73] Assignee: Mannesmann Rexroth GmbH, Fed. Rep. of Germany

[21] Appl. No.: 1,017

[22] Filed: Jan. 7, 1987

[30] Foreign Application Priority Data

Jan. 9, 1986 [DE] Fed. Rep. of Germany ..... 3600364

[51] Int. Cl.[4] ..... F15B 11/10

[52] U.S. Cl. ..... 91/433; 51/165.71; 51/165.87; 51/165.9; 91/361

[58] Field of Search ..... 91/433, 361; 51/165.71, 51/165.87, 165.9

[56] References Cited

U.S. PATENT DOCUMENTS

| | | | |
|---|---|---|---|
| 4,254,690 | 3/1981 | Tlaker | 91/433 |
| 4,490,944 | 1/1985 | Veale | 51/165.9 |
| 4,537,547 | 8/1985 | Cole | 91/361 X |

*Primary Examiner*—Robert G. Nilson

*Attorney, Agent, or Firm*—Harness, Dickey & Pierce

[57] ABSTRACT

A tool, in particular a lapping wheel, is to be positioned by a hydraulic drive cylinder and subsequently pressed against a workpiece. For this purpose a position control and a pressure or force control is provided. The weight change of the lapping disk subjected to wear is automatically detected by measuring the pressure value which is necessary to keep the weight in a state of suspension without support. The pressure value is stored and in the subsequent pressure regulating operation fed as compensating parameter to the pressure control circuit.

10 Claims, 1 Drawing Figure

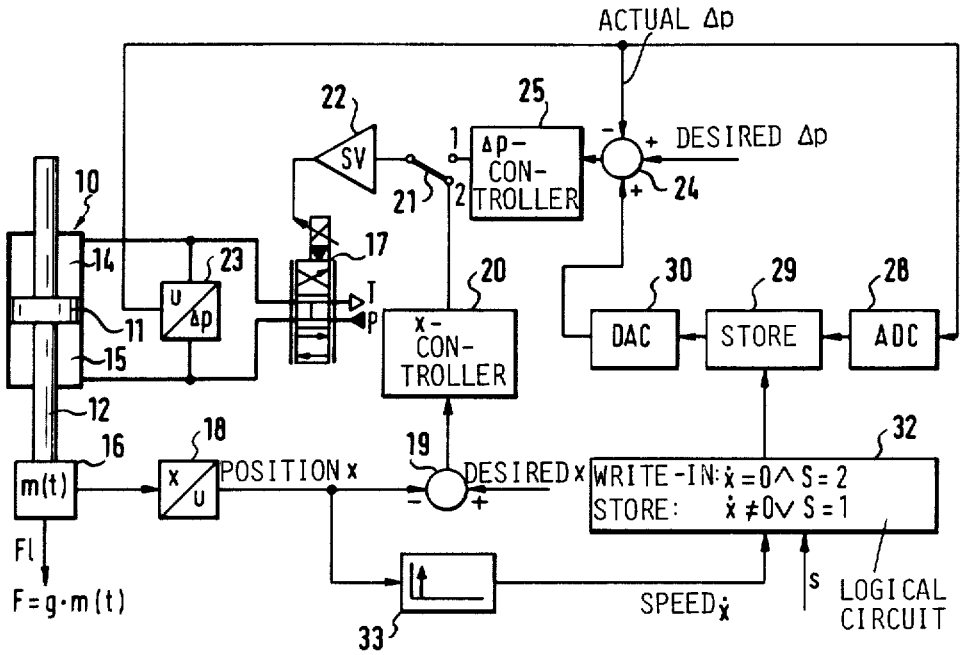
ACTUAL Δp
DESIRED Δp
Δp-CON-TROLLER
SV
x-CON-TROLLER
DAC
STORE
ADC
POSITION x
DESIRED x
WRITE-IN: ẋ = 0 ∧ S = 2
STORE: ẋ ≠ 0 ∨ S = 1
SPEED ẋ
LOGICAL CIRCUIT
m(t)
F = g·m(t)
10
11
12
14
15
16
17
18
19
20
21
22
23
24
25
26
28
29
30
32
33

METHOD AND APPARATUS FOR COMPENSATING THE VARIABLE WEIGHT OF A MASS ACTING ON A HYDRAULIC DRIVE, IN PARTICULAR FOR THE UPRIGHT DRIVE CYLINDER OF A LAPPING MACHINE

The invention relates to a method for compensating the variable weight of a mass acting on a hydraulic drive, in particular for the upright drive cylinder of a lapping machine, and an apparatus for carrying out the method.

In hydraulic controlled drives positions and pressure or forces are frequently regulated in succession in an operating cycle. One use is for example the positioning of the drive for the feed of a tool and pressure regulation in the subsequent working operation.

Known drive control circuits consist of a hydraulic cylinder or oil motor, a servo or proportional valve, a position pickup, a pressure or force pickup and a position regulator and a pressure or force regulator.

If the hydraulic drive is so arranged that the mass connected thereto hangs downwardly so that it continuously exerts a force due to its own weight, the force of the drive set by the pressure regulating circuit is falsified by the weight of the mass. This can be corrected by changing the zero point setting of the force control circuit. The desired value for the force to be exerted by the drive is thus linked to a basic value which corresponds to the weight of the mass.

If however the weight of the mass changes during the working phase or in the course of several individual working operations, constant repetition of the zero-point setting involves much work and time.

The problem underlying the invention is therefore to automate the weight compensation in a drive with variable mass and for this purpose to provide a reliable and simply constructed solution.

Said problem is solved according to the invention by the method features set forth in the characterizing clause of claim 1.

As long as the mass is held without support in a floating or suspended state by the drive, i.e. when the adjusting speed of the drive is zero and the mass is held free from support, a pressure is introduced into the drive which is equal to the instantaneous weight. This pressure is measured, stored and during the subsequent pressure regulation phase entered as additional desired value in the pressure control. A weight change is thus automatically compensated during the working operation so that the pressure regulation is always with the desired pressure without said pressure falsifying the varying weight. This permits an error-free pressure and force regulation.

Further advantageous features of the method according to the invention and an apparatus for carrying out the method are characterized in the subsidiary claims. An example of embodiment of the invention will be explained in detail hereinafter with the aid of the drawing whose single FIGURE shows a block circuit diagram of an automatic weight compensation for a drive cylinder.

In the example of embodiment a drive cylinder 10 is vertically disposed and is provided with a piston having a through piston rod 12 so that on either side of the piston 11 identical cylinder chambers 14 and 15 are formed. The piston 12 carries a mass which in the example of embodiment is a lapping wheel 16 which is first moved up by the drive cylinder 10 from a raised position towards a workpiece which is not shown and then into contact with the workpiece, whereupon a predetermined pressure for carrying out the lapping operation is to be exerted on the lapping wheel 16. Thus, a position operation for approaching the workpiece is followed by a pressure regulating phase for lapping the workpiece.

The two working chambers 14 and 15 of the cylinder 10 are connected via lines to a displacement proportional valve 17 which is made up in known manner and is connectable to a fluid sorce P or a tank T.

The positioning control circuit consists of a displacement pickup 18 by which the travel of the piston rod 12 is converted to an electrical voltage which corresponds to the actual value of the travel and is supplied to a comparison stage 19 to which both the actual value and the desired value of the travel to be executed are supplied, and in said comparison stage an error signal is formed which can be supplied to a position regulator or controller 20 which generates a corresponding control signal which is supplied via a switch 21 and a driving stage 22 to the valve 17. During the feed operation the switch 21 is in position 2 so that the position control is actuated and the feed carried out with the desired speed.

As soon as the lapping wheel has contact with the workpiece the switch 21 is switched over by a means not illustrated to the position 1 in which the pressure regulation for the cylinder 10 is now activated. For this puspose a pressure pickup 23 is provided which is connected to the two cylinder chambers 14 and 15 and thus measures the pressure difference between the two cylinder chambers. This actual value of the pressure difference and a desired value which can be set as required are supplied to a comparison stage 24 in which an error signal is formed which can be supplied to a differential pressure regulator 25 which is connected via the switch 21 to the driving stage 22. Via the pressure regulating circuit 23, 24, 25 it is thus possible in position 1 of the switch 21 to drive the valve 17 and thus the cylinder 10 so that the lapping wheel 16 exerts a predetermined pressure on the workpiece.

In the course of time due to wearing of the lapping wheel 16 the latter loses weight. This weight change, which falsifies the pressure desired value set, is compensated automatically by the apparatus described hereinafter: The pressure pickup 23 is connected via an analog-digital converter 28 to a memory 29 and the output of the memory is connected via a digital-analog converter 30 to the comparison stage 24.

The memory 29 is driven by a logic circuit 32 which decides whether the memory 29 can be loaded with a new measured differential pressure value or blocked. This logic circuit 32 receives a velocity signal from a differentiating stage 33 which is connected to the displacement pickup 18. The differentiating stage 33 converts the position signal x to the corresponding velocity x. In addition the logic circuit 32 receives a signal which shows that the switch 21 is in the position 1 or in the position 2. The signals x and s applied by the switch 21 and the differentiating stage 33 are linked together in the logic circuit 32 which blocks the memory 29 for new loading of a differential pressure value when the switch is in position 1 or the velocity is not equal to zero.

The memory 29 is however cleared for loading with a pressure measured value when the switch is in the position 2 and the velocity signal is equal to zero. In this case the cylinder 10 is in the position regulating phase, i.e. raised from the workpiece. When in this phase the velocity of the drive is zero the weight of the mass held in suspended condition including the lapping wheel 16 is held by the differential pressure introduced into the cylinder chambers 14 and 15. Thus, at zero velocity the differential pressure or the differential force is equal to the instantaneous weight. This pressure difference is measured by the pressure pickup 23, digitized in the converter 28 and then loaded to the memory 29 because in this condition the logic circuit 32 enables the memory 29 for loading. The loading with the new signal corresponding to the weight can thus for example be carried out when the lapping wheel 16 is in the waiting position. As soon as the lapping wheel 16 is moved and/or the switch 21 switched to pressure regulation the memory 29 must be blocked by the logic circuit 32 so that no new pressure signals can be loaded. Then, with the switch 21 switched to position 1 the last value stored can be called up from the memory 29 and entered into the converter 30 where it is converted to an analog signal and applied as basic desired value to the comparison stage 24. The error signal entered by the comparison stage 24 into the regulater 25 results from the addition of the desired value settable as required and the basic desired value minus the actual value of the pressure difference. Thus, an error-free pressure regulation is possible and the weight change of the drive is continuously compensated so that the desired pressure set is maintained always at the set value even when the weight changes.

I claim:

1. Method for compensating the variable weight of a mass acting on a hydraulic drive, in particular for the upright drive cylinder of a lapping machine, comprising a pressure pickup and a pressure regulator for driving a directional valve setting the pressure exerted by the drive, characterized in that when the mass is held in suspension without support the pressure set at the drive is measured and in the subsequent pressure regulation the pressure value is supplied to the pressure regulator as compensation parameter.

2. Method according to claim 1, characterized in that the pressure value is digitized and stored.

3. Method according to claim 2, characterized in that the pressure value is called up from the memory during a pressure regulating phase of the drive.

4. Method according to claim 1, characterized in that the pressure value is stored during a position regulating phase of the drive.

5. Apparatus for carrying out the method according to claim 1 characterized in that connected to the pressure pickup (23) is a memory (29) which is addressed by a logic circuit (32) and from which the pressure value measured and stored when the mass is held in suspension without support can be supplied in the subsequent pressure regulation as basic desired or reference value to a desired value/actual value comparison stage (24) preceding the pressure regulator (25).

6. Apparatus according to claim 5, characterized in that the logic circuit (32) is connected via a differentiating stage (33) to the displacement pickup (18) of the drive.

7. Apparatus according to claim 5 characterized in that the memory (29) is connected via an analog-digital converter (28) to the pressure pickup (23) and via a digitial-analog converter (30) to the comparison stage (24).

8. Apparatus according to claim 5 comprising a hydraulic cylinder as drive and a differential pressure meter connected to both cylinder chambers, characterized in that the differential pressure is stored as compensation parameter and supplied to the comparison stage (24).

9. Apparatus according to claim 8, characterized in that a position regulator (20) connected to the displacement pickup (18) is provided and the pressure regulator (25) and position regulator (20) are selectively connectable via a switch (21) to the directional valve, and in dependence upon the switch position the logic circuit (32) is activatable for entering a new differential pressure value when the position regulation is activated and the stroke speed of the cylinder is zero.

10. Apparatus according to claim 8 or 9, characterized in that the memory (29) during an adjustment movement of the cylinder and/or when the pressure regulation is activated is blocked against loading with a new differential pressure value and the previously stored differential pressure value can be called up from the memory.

* * * * *

UNITED STATES PATENT AND TRADEMARK OFFICE

CERTIFICATE OF CORRECTION

PATENT NO. : 4,712,470

DATED : December 15, 1987

INVENTOR(S) : Jurgen Schmitz

It is certified that error appears in the above-identified patent and that said Letters Patent is hereby corrected as shown below:

Column 4, line 40, Claim 10, delete "or 9".

Signed and Sealed this

Twenty-eighth Day of June, 1988

*Attest:*

*Attesting Officer*

DONALD J. QUIGG

*Commissioner of Patents and Trademarks*